US009190070B2

(12) United States Patent
Sugiyama

(10) Patent No.: US 9,190,070 B2
(45) Date of Patent: Nov. 17, 2015

(54) SIGNAL PROCESSING METHOD, INFORMATION PROCESSING APPARATUS, AND STORAGE MEDIUM FOR STORING A SIGNAL PROCESSING PROGRAM

(75) Inventor: Akihiko Sugiyama, Tokyo (JP)

(73) Assignee: NEC CORPORATION, Tokyo (JP)

( * ) Notice: Subject to any disclaimer, the term of this patent is extended or adjusted under 35 U.S.C. 154(b) by 608 days.

(21) Appl. No.: 13/503,791

(22) PCT Filed: Nov. 2, 2010

(86) PCT No.: PCT/JP2010/069869

§ 371 (c)(1),
(2), (4) Date: Apr. 24, 2012

(87) PCT Pub. No.: WO2011/055829

PCT Pub. Date: May 12, 2011

(65) Prior Publication Data

US 2012/0207326 A1 Aug. 16, 2012

(30) Foreign Application Priority Data

Nov. 6, 2009 (JP) ..... 2009-255419

(51) Int. Cl.
*G10L 21/0208* (2013.01)

(52) U.S. Cl.
CPC ..... *G10L 21/0208* (2013.01)

(58) Field of Classification Search
CPC ..... H04R 3/005; H04R 2410/07; G10L 21/0208; G10L 2021/02165; G10L 21/0216; G10L 21/02; G11B 20/24
USPC ..... 379/406.01–406.16, 391–392.01; 381/94.1
See application file for complete search history.

(56) References Cited

U.S. PATENT DOCUMENTS

| | | | | |
|---|---|---|---|---|
| 4,630,304 | A * | 12/1986 | Borth et al. | 381/94.3 |
| 5,732,134 | A * | 3/1998 | Sih | 379/406.13 |
| 5,757,937 | A * | 5/1998 | Itoh et al. | 381/94.3 |
| 6,001,131 | A * | 12/1999 | Raman | 704/226 |
| 6,570,985 | B1 * | 5/2003 | Romesburg | 379/406.08 |
| 6,606,382 | B2 * | 8/2003 | Gupta | 379/406.05 |
| 6,850,783 | B1 * | 2/2005 | Romesburg | 455/570 |
| 6,859,531 | B1 * | 2/2005 | Deisher | 379/406.05 |
| 6,947,549 | B2 * | 9/2005 | Yiu et al. | 379/406.01 |
| 2004/0102967 | A1 * | 5/2004 | Furuta et al. | 704/226 |

(Continued)

FOREIGN PATENT DOCUMENTS

| | | |
|---|---|---|
| JP | 5-316186 A | 11/1993 |
| JP | 8-221092 A | 8/1996 |

(Continued)

OTHER PUBLICATIONS

Search report issued by the European Patent Office dated Jul. 8, 2013 in corresponding application No. 10828387.0.

(Continued)

*Primary Examiner* — Simon Sing
(74) *Attorney, Agent, or Firm* — Sughrue Mion, PLLC

(57) ABSTRACT

Provided is a noise suppressing technology capable of suppressing various noises including unknown noises without storing information relating to a large number of noises in advance. Noises in a degraded signal are suppressed and noise information is generated on the basis of a noise suppression result. The noises in the degraded signal are suppressed using the generated noise information.

8 Claims, 8 Drawing Sheets

(56) References Cited

U.S. PATENT DOCUMENTS

| | | | | |
|---|---|---|---|---|
| 2006/0050895 | A1 | 3/2006 | Nemoto et al. | |
| 2008/0059154 | A1* | 3/2008 | Ramo et al. | 704/200.1 |
| 2008/0064357 | A1* | 3/2008 | Gozen | 455/296 |
| 2008/0101622 | A1* | 5/2008 | Sugiyama | 381/66 |
| 2010/0211382 | A1 | 8/2010 | Sugiyama | |

FOREIGN PATENT DOCUMENTS

| | | | |
|---|---|---|---|
| JP | 2001-215990 | A | 8/2001 |
| JP | 2004-214784 | A | 7/2004 |
| JP | 2006-065067 | A | 3/2006 |
| JP | 2006-279185 | A | 10/2006 |
| JP | 2006-287387 | A | 10/2006 |
| JP | 4282227 | B2 | 6/2009 |
| JP | 2009-276528 | A | 11/2009 |
| WO | 2007/058121 | A1 | 5/2007 |

OTHER PUBLICATIONS

Communication dated Dec. 27, 2013, issued by the Japanese Patent Office in corresponding Application No. 2009-255419.

* cited by examiner

SIGNAL PROCESSING METHOD, INFORMATION PROCESSING APPARATUS, AND STORAGE MEDIUM FOR STORING A SIGNAL PROCESSING PROGRAM

CROSS REFERENCE TOP RELATED APPLICATIONS

This application is a National Stage of International Application No. PCT/JP2010/069869 filed Nov. 2, 2010, claiming priority based on Japanese Patent Application Nos. 2009-255419 filed Nov. 6, 2009, the contents of all of which are incorporated herein by reference in their entirety.

This application is based upon and claims the benefit of priority from Japanese patent application No. 2009-255419, filed on Nov. 6, 2009, the disclosure of which is incorporated herein in its entirety by reference.

TECHNICAL FIELD

The present invention relates to a signal processing technique of suppressing noise in a noisy signal to enhance a target signal.

BACKGROUND ART

A noise suppressing technology is known as a signal processing technology of partially or completely suppressing noise in a noisy signal (a signal containing a mixture of noise and a target signal) and outputting an enhanced signal (a signal obtained by enhancing the target signal). For example, a noise suppressor is a system that suppresses noise mixed in a target audio signal. The noise suppressor is used in various audio terminals such as mobile phones.

Concerning technologies of this type, patent literature 1 discloses a method of suppressing noise by multiplying an input signal by a spectral gain smaller than 1. Patent literature 2 discloses a method of suppressing noise by directly subtracting estimated noise from a noisy signal.

The techniques described in patent literatures 1 and 2 need to estimate noise from the target signal that has already become noisy due to the mixed noise. However, there are limitations on accurately estimating noise only from the noisy signal. Hence, the methods described in patent literatures 1 and 2 are effective only when the noise is much smaller than the target signal. If the condition that the noise is much smaller than the target signal is not satisfied, the noise estimate accuracy is poor. For this reason, the methods described in patent literatures 1 and 2 can achieve no sufficient noise suppression effect, and the enhanced signal includes a larger distortion.

On the other hand, patent literature 3 discloses a noise suppressing system capable of implementing a sufficient noise suppression effect and a smaller distortion in the enhanced signal even if the condition that the noise is much smaller than the target signal is not satisfied. Assuming that the characteristics of noise to be mixed into the target signal are known in advance to a certain extent, the method described in patent literature 3 subtracts previously recorded noise information (information about the noise characteristics) from the noisy signal, thereby suppressing the noise. Patent literature 3 also discloses a method of, if an input signal power obtained by analyzing an input signal is large, integrating a large coefficient into noise information, or if the input signal power is small, integrating a small coefficient, and subtracting the integration result from the noisy signal.

CITATION LIST

Patent Literature

[PTL 1] Japanese Patent No. 4282227
[PTL 2] Japanese Patent Laid-Open No. 8-221092
[PTL 3] Japanese Patent Laid-Open No. 2006-279185

SUMMARY OF INVENTION

However, the arrangement disclosed in patent literature 3 described above needs to store noise characteristic information in advance, and the types of erasable noise are extremely limited. To increase the types of erasable noise, a number of pieces of noise information need to be recorded. This increases the necessary memory size and the manufacturing cost of the apparatus. In addition, the technique disclosed in patent literature 3 cannot suppress unknown noise different from the stored noise information.

The present invention has been made in consideration of the above-described situation, and has as its exemplary object to provide a signal processing technique of solving the above-described problems.

In order to achieve the above exemplary object, a signal processing method according to an exemplary aspect of the present invention includes, when suppressing a noise in a degraded signal, generating noise information depending on a noise suppression result of the degraded signal and, suppressing the noise in the degraded signal using the generated noise information.

In order to achieve the above exemplary object, an information processing apparatus according to another exemplary aspect of the present invention includes a noise suppressor that suppresses a noise in a degraded signal and, a noise information generation unit that generates noise information based on a result of suppression of the noise in the degraded signal, wherein the noise suppressor suppresses the noise in the degraded signal using the noise information.

In order to achieve the above exemplary object, a signal processing program stored in a computer readable non-transitory medium according to still another exemplary aspect of the present invention causes a computer to execute a process of generating noise information based on a result of a process of suppressing a noise and, a process of suppressing a noise in a degraded signal using the generated noise information.

ADVANTAGEOUS EFFECT OF INVENTION

According to the present invention, it is possible to provide a signal processing technique of suppressing various kinds of noise including unknown noise without storing a number of pieces of noise information in advance.

EXEMPLARY EMBODIMENTS

Exemplary embodiments will now be described in detail by way of example with reference to the accompanying drawings. Note that the constituent elements described in the exemplary embodiments are merely examples, and the technical scope is not limited by the following exemplary embodiments.

First Exemplary Embodiment

<Overall Arrangement>

Figure 1:
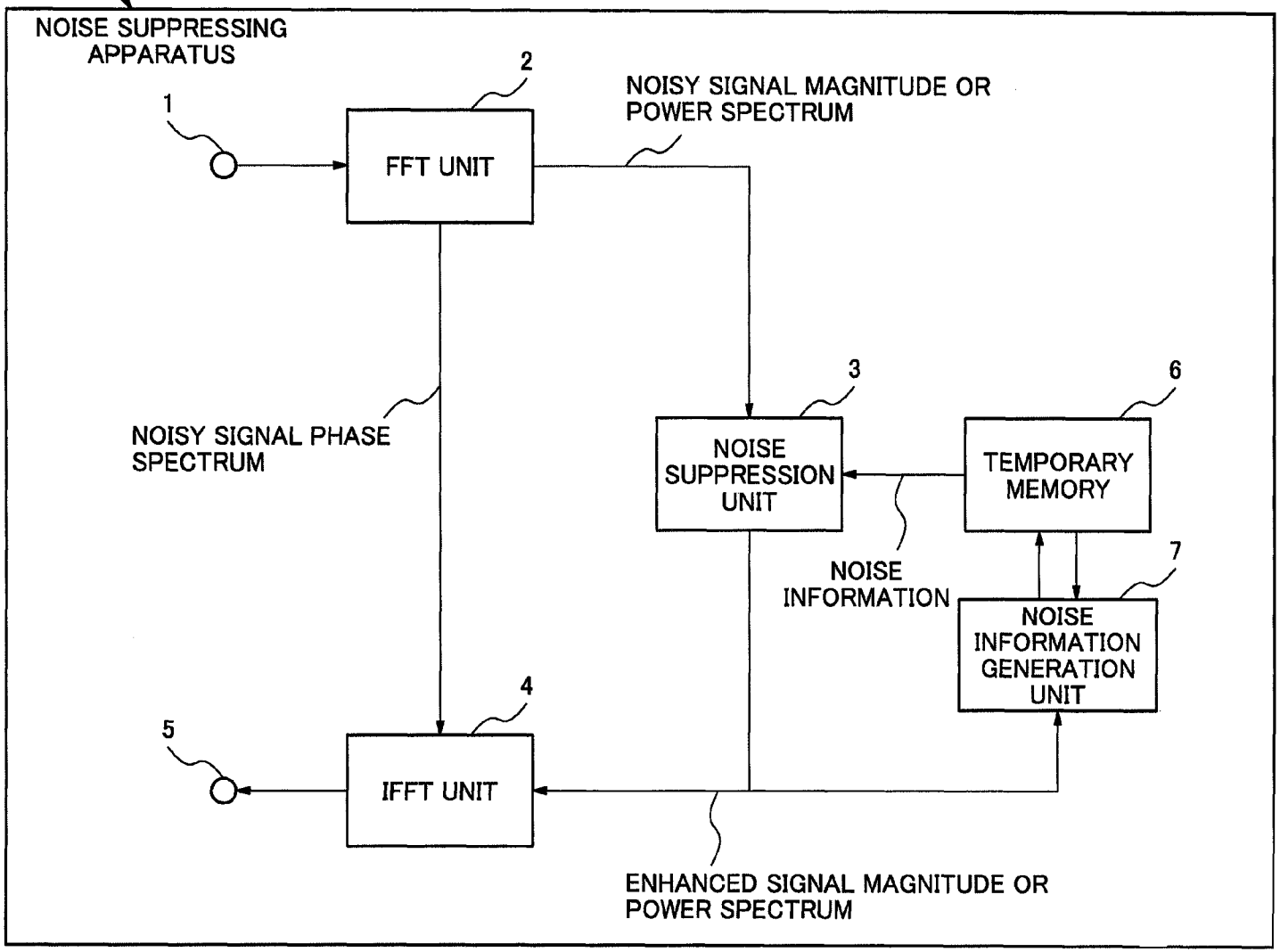
FIG. 1 is a block diagram showing the schematic arrangement of a noise suppressing apparatus 100 according to the first exemplary embodiment of the present invention.
Figure 8:
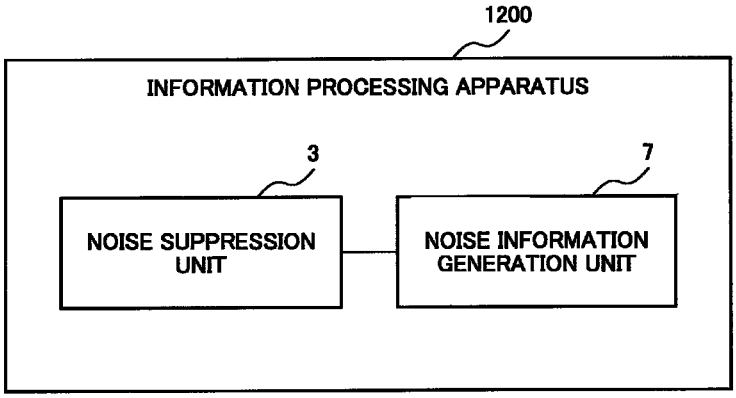
FIG. 8 is a block diagram showing an example of an arrangement of an information processing apparatus 1200 according to the present invention.

As the first exemplary embodiment for implementing a signal processing method, a noise suppressing apparatus will be explained, which partially or completely suppresses noise in a noisy signal (a signal containing a mixture of noise and a target signal) and outputs an enhanced signal (a signal obtained by enhancing the target signal). FIG. 1 is a block diagram showing the overall arrangement of a noise suppressing apparatus 100. The noise suppressing apparatus 100 functions as part of a device such as a digital camera, a notebook computer, or a mobile phone. However, the exemplary embodiment is not limited to this and is also applicable to an information processing apparatus of any type that requires noise removal from an input signal. FIG. 8 is a block diagram showing an example of an arrangement of an information processing apparatus 1200 according to the exemplary embodiment. The information processing apparatus 1200 includes a noise suppression unit 3 and a noise information generation unit 7.

The degraded signal (signal in which target signal and noise are mixed) is inputted to an input terminal 1 as a sample value sequence. An FFT unit 2 performs transform such as Fourier transform of the noisy signal supplied to the input terminal 1, thereby dividing the signal into a plurality of frequency components. The noise suppression unit 3 receives the magnitude spectrum out of the plurality of frequency components, whereas an IFFT unit 4 is provided with the phase spectrum. Note that the magnitude spectrum is supplied to the noise suppression unit 3 in this case. However, the exemplary embodiment is not limited to this, and a power spectrum corresponding to the square of the magnitude spectrum may be supplied to the noise suppression unit 3.

A temporary memory 6 includes a memory element such as a semiconductor memory and stores noise information (information about noise characteristics). In particular, the temporary memory 6 stores noise spectrum forms as the noise information. However, the temporary memory 6 can also store, for example, the frequency characteristics of phases and features such as the intensities and time-rate changes for a specific frequency in place of or together with the spectra. The noise information can also include statistics (maxima, minima, variances, and medians) and the like.

The noise suppression unit 3 suppresses a noise at each frequency using the degraded signal magnitude spectrum supplied by the FFT unit 2 and the noise information supplied by the temporary memory 6, and provides the IFFT unit 4 with an enhanced signal magnitude spectrum as a noise suppression result. The IFFT unit 4 inversely transforms the combination of the enhanced signal magnitude spectrum supplied from the noise suppression unit 3 and the degraded signal phase supplied from the FFT unit 2, and supplies an enhanced signal sample to an output terminal 5.

The noise information generation unit 7 is also simultaneously provided with the enhanced signal magnitude spectrum as the noise suppression result. The noise information generation unit 7 generates new noise information based on the enhanced signal magnitude spectrum as the noise suppression result and supplies the new noise information to the temporary memory 6. The temporary memory 6 adapts current noise information using the new noise information supplied from the noise information generation unit 7.

<Arrangement of FFT Unit 2>

Figure 2:
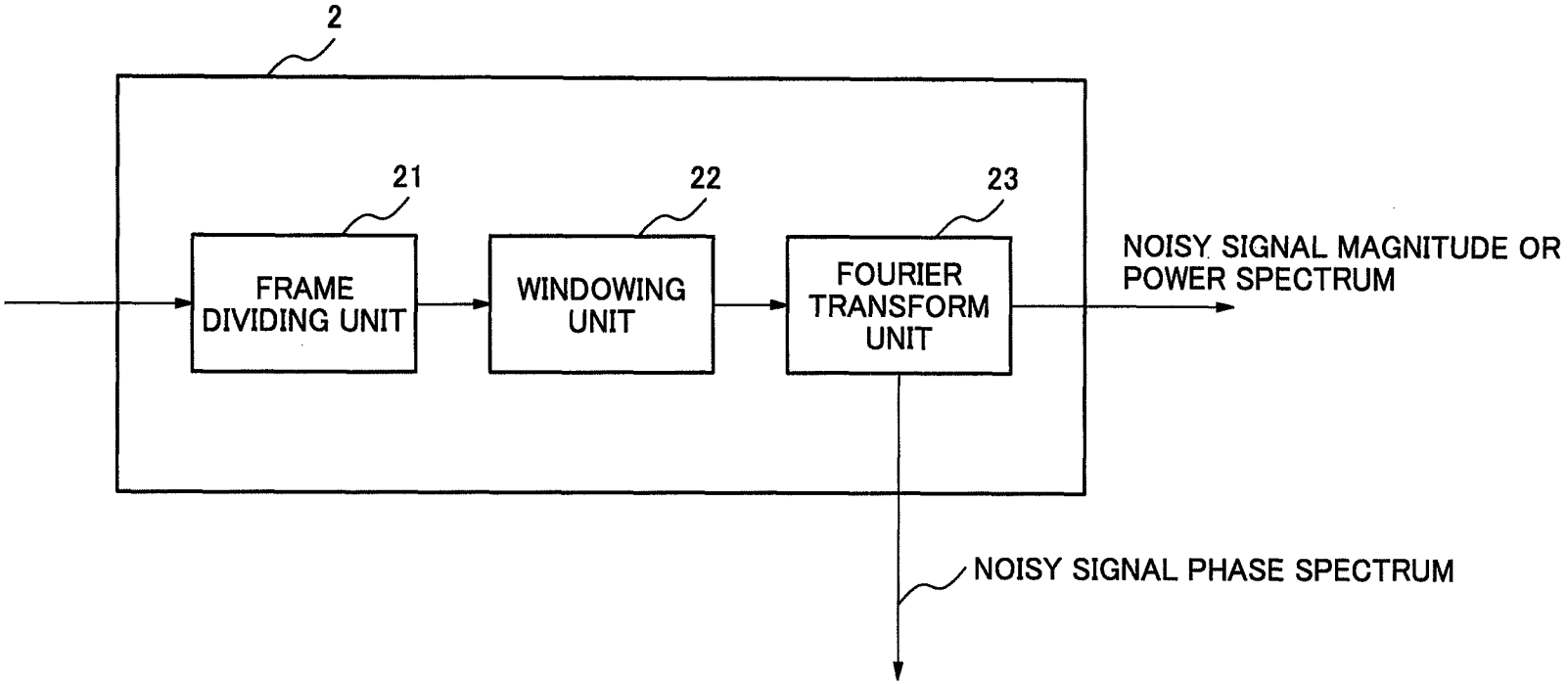
FIG. 2 is a block diagram showing the arrangement of an FFT (Fast Fourier Transform) unit 2 included in the noise suppressing apparatus 100 according to the first exemplary embodiment of the present invention.

FIG. 2 is a block diagram showing the arrangement of the FFT unit 2. As shown in FIG. 2, the FFT unit 2 includes a frame dividing unit 21, a windowing unit 22, and a Fourier transform unit 23. The frame dividing unit 21 receives the noisy signal sample and divides it into frames corresponding to K/2 samples, where K is an even number. The noisy signal sample divided into frames is supplied to the windowing unit 22 and multiplied by a window function w(t). The signal obtained by windowing an nth frame input signal yn(t) (t=0, 1, . . . , K/2−1) by w(t) is given by $$\bar{y}_n(t)=w(t)y_n(t) \tag{1}$$

Also widely conducted is windowing two successive frames partially overlaid (overlapping) each other. Assume that the overlap length is 50% the frame length. For t=0, 1, . . . , K/2−1, the windowing unit 22 outputs $\bar{y}_n(t)$ and $\bar{y}_n(t+K/2)$ given by $$\left.\begin{aligned}\bar{y}_n(t) &= w(t)y_{n-1}(t-K/2)\\ \bar{y}_n(t+K/2) &= w(t+K/2)y_n(t)\end{aligned}\right\} \tag{2}$$

A symmetric window function is used for a real signal. The window function makes the input signal match the output signal except an error when the spectral gain is set to 1 in the MMSE STSA method or zero is subtracted in the SS method. This means w(t)=w(t+K/2)=1.

The example of windowing two successive frames that overlap 50% will continuously be described below. The windowing unit 22 can use, for example, a hanning window w(t) given by $$w(t)=\begin{cases}0.5+0.5\cos\left(\dfrac{\pi(t-K/2)}{K/2}\right), & 0\le t<K\\ 0, & \text{otherwise}\end{cases} \tag{3}$$

Alternatively, the windowing unit 22 may use various window functions such as a hamming window, a Kaiser window, and a Blackman window. The windowed output is supplied to the Fourier transform unit 23 and transformed into a noisy signal spectrum Yn(k). The noisy signal spectrum Yn(k) is separated into the phase and the magnitude. A noisy signal phase spectrum argYn(k) is supplied to the IFFT unit 4, whereas a noisy signal magnitude spectrum |Yn(k)| is supplied to the noise suppression unit 3. As already described, the FFT unit 2 can use the power spectrum instead of the magnitude spectrum.

<Arrangement of IFFT Unit 4>

Figure 3:
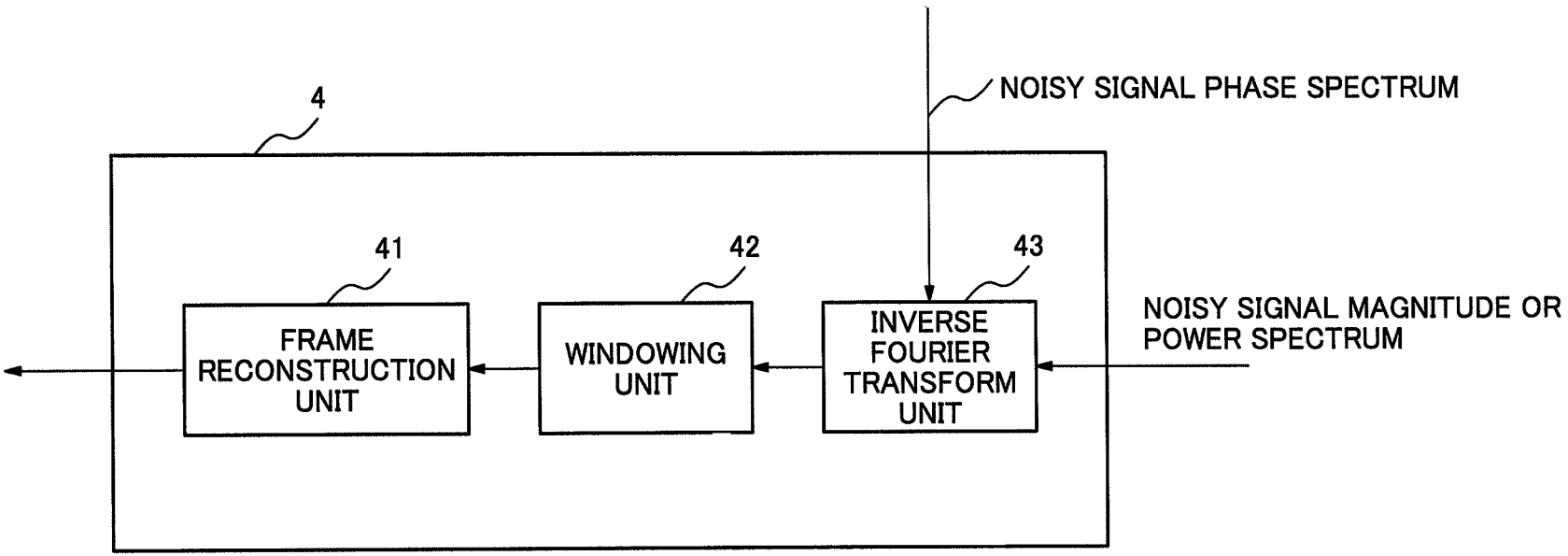
FIG. 3 is a block diagram showing the arrangement of an IFFT (Inverse Fast Fourier Transform) unit 4 included in the noise suppressing apparatus 100 according to the first exemplary embodiment of the present invention.

FIG. 3 is a block diagram showing the arrangement of the IFFT unit 4. As shown in FIG. 3, the IFFT unit 4 includes an inverse Fourier transform unit 43, a windowing unit 42, and a frame reconstruction unit 41. The inverse Fourier transform unit 43 combines the enhanced signal magnitude spectrum supplied from the noise suppression unit 3 with the noisy signal phase spectrum argYn(k) supplied from the FFT unit 2 to obtain an enhanced signal given by $$\overline{X}_n(k)=|\overline{X}_n(k)|\cdot\arg Y_n(k) \tag{4}$$

The inverse Fourier transform unit 43 inversely Fourier-transforms the resultant enhanced signal. The inversely Fourier-transformed enhanced signal is supplied to the windowing unit 42 as a series of time domain samples xn(t) (t=0, 1, . . . , K−1) in which one frame includes K samples and multiplied by the window function w(t). The signal obtained by windowing an nth frame input signal xn(t) (t=0, 1, . . . , K/2−1) by w(t) is given by $$\overline{x}_n(t)=w(t)x_n(t) \tag{5}$$

Also widely conducted is windowing two successive frames partially overlaid (overlapping) each other. Assume that the overlap length is 50% the frame length. For t=0, 1, . . . , K/2−1, the windowing unit 42 outputs $\overline{x}_n(t)$ and $\overline{x}_n(t+K/2)$ given by $$\left.\begin{aligned}\overline{x}_n(t) &= w(t)x_{n-1}(t-K/2)\\ \overline{x}_n(t+K/2) &= w(t+K/2)x_n(t)\end{aligned}\right\} \tag{6}$$

and provides the frame reconstruction unit 41 with them.

The frame reconstruction unit 41 extracts the output of two adjacent frames from the windowing unit 42 for every K/2 samples, overlays them, and obtains an output signal $\hat{x}_n(t)$ given by $$\hat{x}_n(t)=\overline{x}_{n-1}(t+K/2)+\overline{x}_n(t) \tag{7}$$

for t=0, 1, . . . , K−1. The frame reconstruction unit 41 provides the output terminal 5 with the resultant output signal.

Note that the transform in the FFT unit 2 and the IFFT unit 4 in FIGS. 2 and 3 has been described above as Fourier transform. However, the FFT unit 2 and the IFFT unit 4 can use any other transform such as cosine transform, modified discrete cosine transform (MDCT), Hadamard transform, Haar transform, or Wavelet transform in place of the Fourier transform. For example, cosine transform or modified cosine transform obtains only a magnitude as a transform result. This obviates the necessity for the path from the FFT unit 2 to the IFFT unit 4 in FIG. 1. In addition, the noise information recorded in the temporary memory 6 needs to include only magnitudes (or powers), contributing to reduction of the memory size and the number of computations of a noise suppressing process. Haar transform allows to omit multiplication and reduce the area of an LSI chip. Since Wavelet transform can change the time resolution depending on the frequency, better noise suppression is expected.

Alternatively, after the FFT unit 2 has integrated a plurality of frequency components, the noise suppression unit 3 may perform actual suppression. In this case, the FFT unit 2 can achieve high sound quality by integrating more frequency components from the low frequency range where the discrimination capability of hearing characteristics is high to the high frequency range with a poorer capability. When noise suppression is executed after integrating a plurality of frequency components, the number of frequency components to which noise suppression is applied decreases. The noise suppressing apparatus 100 can thus decrease the whole number of computations.

<Processing of Noise Suppression Unit 3>

The noise suppression unit 3 can perform various kinds of suppression. Typical suppressing methods are the SS (Spectrum Subtraction) method and the MMSE STSA (Minimum Mean-Square Error Short-Time Spectral Amplitude Estimator) method. When using the SS method, the noise suppression unit 3 subtracts the noise information supplied by the temporary memory 6 from the degraded signal magnitude spectrum supplied by the FFT unit 2. When using the MMSE STSA method, the noise suppression unit 3 calculates a suppression coefficient for each of the plurality of frequency components using the noise information supplied by the temporary memory 6 and the degraded signal magnitude spectrum supplied by the FFT unit 2. The noise suppression unit 3 multiplies the degraded signal magnitude spectrum by the suppression coefficient. The suppression coefficient is determined so as to minimize the mean square power of the enhanced signal.

The noise suppression unit 3 can apply flooring to avoid excessive noise suppression. Flooring is a method of avoiding suppression beyond the maximum suppression amount. A flooring parameter determines the maximum suppression amount. When using the SS method, the noise suppression unit 3 imposes restrictions so the result obtained by subtracting the modified noise information from the noisy signal magnitude spectrum is not smaller than the flooring parameter. More specifically, if the subtraction result is smaller than the flooring parameter, the noise suppression unit 3 replaces the subtraction result with the flooring parameter. In case of using the MMSE STSA method, if the spectral gain obtained from the modified noise information and the noisy signal magnitude spectrum is smaller than the flooring parameter, the noise suppression unit 3 replaces the spectral gain with the flooring parameter. Details of the flooring are disclosed in literature "M. Berouti, R. Schwartz, and J. Makhoul, "Enhancement of speech corrupted by acoustic noise", Proceedings of ICASSP'79, pp. 208-211, April 1979". When the flooring is introduced, the noise suppression unit 3 does not perform excessive suppression. The flooring can prevent the enhanced signal from having a larger distortion.

The noise suppression unit 3 can also set the number of frequency components of the noise information to be smaller than the number of frequency components of the noisy signal spectrum. At this time, a plurality of frequency components share a plurality of pieces of noise information. The frequency resolution of the noisy signal spectrum is higher than in a case in which the plurality of frequency components are integrated for both the noisy signal spectrum and the noise information. For this reason, the noise suppression unit 3 can achieve high sound quality by calculation in an amount smaller than in case of the absence of frequency component integration. Japanese Patent Laid-Open No. 2008-203879 discloses details of suppression using noise information whose number of frequency components is smaller than the number of frequency components of the noisy signal spectrum.

<Arrangement of Noise Information Generation Unit 7>

The enhanced signal magnitude spectrum as the noise suppression result is supplied to the noise information generation unit 7. The noise information generation unit 7 generates new noise information using the noise suppression result and, adapts the noise information stored in the temporary memory 6 using the new noise information. For example, a flat-shaped signal spectrum is prepared as a default value of the noise information stored in the temporary memory 6. The noise information generation unit 7 generates the new noise information depending on the noise suppression result in which the signal spectrum is used as the noise information. The noise information generation unit 7 adapts the noise information, stored in the temporary memory 6, which is already used for suppression.

When generating the new noise information using the noise suppression result fed back to the noise information generation unit 7, the noise information generation unit 7 generates the noise information such that the larger the noise suppression result at a timing without target signal input is (the larger the noise remaining without being suppressed is), the larger the noise information is. The large noise suppression result at the timing without target signal input indicates insufficient suppression. For this reason, the noise information is preferably made larger. When the noise information is large, the subtraction value of the SS method is large, and the noise suppression result thus becomes small. In multiplication-based suppression such as the MMSE STSA method, the signal-to-noise ratio (SNR) estimate to be used to calculate the suppression coefficient is small, and therefore, a small suppression coefficient can be obtained. This leads to more intensive noise suppression. A plurality of methods are available to generate the new noise information. A re-calculation algorithm and a recursive adaptation algorithm will be described as examples.

In an ideal noise suppression result, noise is completely suppressed. The noise information generation unit 7 can recalculate or recursively adapt the noise information, for example, when the magnitude or power of the degraded signal is small so as to completely suppress noise. This is because the power of the signal other than the noise to be suppressed is small at high probability when the magnitude or power of the degraded signal is small. The noise information generation unit 7 can detect the small magnitude or power of the degraded signal using the fact that power or an absolute value of the magnitude of the degraded signal is smaller than a threshold.

The noise information generation unit 7 can also detect the small magnitude or power of the degraded signal using the fact that the difference between the magnitude or power of the degraded signal and the noise information recorded in the temporary memory 6 is smaller than a threshold. That is, the noise information generation unit 7 uses the fact that when the magnitude or power of the degraded signal is similar to the noise information, the noise information makes up a large part of the degraded signal (the SNR is low). Especially, the noise information generation unit 7 can compare the spectral envelopes using a combination of information at a plurality of frequency points, thereby raising the detection accuracy.

The noise information in the SS method is recalculated so as to equal the degraded signal magnitude spectrum for each frequency at the timing without target signal input. In other words, the noise information generation unit 7 makes the degraded signal magnitude spectrum $|Yn(k)|$ supplied from the FFT unit 2 when only noise has been input match noise information $\nu n(k)$. That is, the noise information generation unit 7 calculates the noise information $\nu n(k)$ by using $$\nu n(k)=|Yn(k)| \tag{8}$$

where n is the frame number, and k is the frequency number.

The noise information generation unit 7 may use an average of the noise information $\nu n(k)$ instead of directly using the noise information $\nu n(k)$. The average may be an average (a moving average using a slide window) based on an FIR filter or an average (leaky integration) based on an IIR filter.

On the other hand, recursive adaptation of the noise information in the SS method is done by gradually adapting the noise information such that the enhanced signal magnitude spectrum at the timing without target signal input approaches zero for each frequency. When using a perturbation method for recursive adaptation, the noise information generation unit 7 calculates $\nu n+1(k)$ using an error $en(k)$ of the nth frame for the frequency number k as $$\nu n+1(k)=\nu n(k)+\mu en(k) \tag{9}$$

where $\mu$ is a microconstant called a step size. If the noise information $\nu n$ (k) obtained by the calculation is to be used immediately, the noise information generation unit 7 uses $$\nu n(k)=\nu n-1(k)+\mu en(k) \tag{10}$$

in place of equation (9). That is, the noise information generation unit 7 calculates the current noise information $\nu n(k)$ using the current error and immediately applies it. The noise information generation unit 7 can implement accurate noise suppression in real time by immediately adapting the noise information.

Alternatively, the noise information generation unit 7 may calculate the noise information $\nu n+1(k)$ using a signum function $\mathrm{sgn}\{en(k)\}$ representing only the sign of the error as $$\nu n+1(k)=\nu n(k)+\mu\cdot\mathrm{sgn}\{en(k)\} \tag{11}$$

Similarly, the noise information generation unit 7 may use any other adaptive algorithm (recursive adaptation algorithm).

When using the MMSE STSA method, the noise information generation unit 7 recursively adapts the noise information. The noise information generation unit 7 adapts the noise information $\nu n(k)$ for each frequency by the same methods as those described using equations (9) to (11).

As the characteristic features of the above-described re-calculation and recursive adaptation algorithms serving as the noise information adaptation method, the re-calculation algorithm has a high follow-up speed, and the recursive adaptation algorithm has a high accuracy. To make use these characteristic features, the noise information generation unit 7 may change the adaptation method so as to, for example, first use the re-calculation algorithm and then use the recursive adaptation algorithm. When determining the timing to change the adaptation method, the noise information generation unit 7 may change the adaptation method on condition that the noise information has sufficiently approached the optimum value. Alternatively, the noise information generation unit 7 may change the adaptation method when, for example, a predetermined time has elapsed. Otherwise, the noise information generation unit 7 may change the adaptation method when the modification amount of the noise information has fallen below a predetermined threshold.

As described above, the noise suppressing apparatus 100 of the exemplary embodiment generates, based on the noise suppression result, the noise information to be used for the noise suppression. It is therefore possible to suppress various kinds of noises including an unknown noise without storing a number of pieces of noise information in advance.

Second Exemplary Embodiment

A second exemplary embodiment will be described. The noise information generation unit 7 of the second exemplary embodiment generates noise information by multiplying basic information permanently stored in a non-volatile memory, or the like, by a scaling factor. For example, arbitrary information like a flat-shaped signal spectrum is prepared as the basic information (default value) of the noise information. The noise information generation unit 7 generates the noise information by multiplying the basic information by the scaling factor and, after that, adapts the noise information and the scaling factor thereof depending on a noise suppression result using the noise information. The adaptation of the noise information is described in the first exemplary embodiment in detail. Adaptation of the scaling factor is therefore described here.

When generating the scaling factor using the noise suppression result, the noise information generation unit 7 generates the scaling factor such that the larger the noise suppression result at a timing without target signal input is (the larger the noise remaining without being suppressed is), the larger the noise information is. The large noise suppression result at the timing without target signal input indicates insufficient suppression. For this reason, the noise information is preferably made larger by changing the scaling factor. A plurality of methods are available to adapt the scaling factor. A re-calculation algorithm and a recursive adaptation algorithm will be described as examples.

In an ideal noise suppression result, noise is completely suppressed. The noise information generation unit 7 can recalculate or recursively adapt the scaling factor, for example, when the magnitude or power of the degraded signal is small so as to completely suppress noise. This is because the power of the signal other than the noise to be suppressed is small at high probability when the magnitude or power of the degraded signal is small. The noise information generation unit 7 can detect the small magnitude or power of the degraded signal using the fact that power or an absolute value of the magnitude of the degraded signal is smaller than a threshold.

The noise information generation unit 7 can also detect the small magnitude or power of the degraded signal using the fact that the difference between the magnitude or power of the degraded signal and the noise information recorded in the temporary memory 6 is smaller than a threshold. That is, the noise information generation unit 7 uses the fact that when the magnitude or power of the degraded signal is similar to the noise information, the noise makes up a large part of the degraded signal (the SNR is low). Especially, the noise information generation unit 7 can compare the spectral envelopes using a combination of information at a plurality of frequency points, thereby raising the detection accuracy.

The scaling factor in the SS method is recalculated so that the noise information equals the degraded signal magnitude spectrum for each frequency at the timing without target signal input. In other words, the noise information generation unit 7 obtains the scaling factor $\alpha n(k)$ so that the degraded signal magnitude spectrum $|Yn(k)|$ supplied from the FFT unit 2 when only noise has been input matches the product of the scaling factor $\alpha n$ and the basic information $\nu n(k)$. That is, the scaling factor $\alpha n(k)$ is calculated by using $$\alpha n(k)=|Yn(k)|/\nu(k) \tag{12}$$

where n is the frame number, and k is the frequency number.

On the other hand, recursive adaptation of the scaling factor in the SS method is done by gradually adapting the scaling factor such that the enhanced signal magnitude spectrum at the timing without target signal input approaches zero for each frequency. When using the LMS (Least Squares Method) algorithm for recursive adaptation, the noise information generation unit 7 calculates $\alpha n+1(k)$ using an error en(k) of the nth frame for the frequency number k as $$\alpha n+1(k)=\alpha n(k)+\mu en(k)\nu(k) \tag{13}$$

where $\mu$ is a microconstant called a step size. If the scaling factor $\alpha n(k)$ obtained by the calculation is to be used by the noise suppressing apparatus 100 immediately, the noise information generation unit 7 uses $$\alpha n(k)=\alpha n-1(k)+\mu en(k)\nu(k) \tag{14}$$

in place of equation (13). That is, the noise information generation unit 7 calculates the current scaling factor $\alpha n(k)$ using the current error and immediately applies the noise suppressing apparatus 100. The noise information generation unit 7 can implement accurate noise suppression in real time by immediately adapting the scaling factor.

When using the NLMS (Normalized Least Squares Method) algorithm, the noise information generation unit 7 calculates the scaling factor $\alpha n+1(k)$ using the above-described error en(k) as $$\alpha n+1(k)=\alpha n(k)+\mu en(k)\nu(k)/\sigma n(k)^2 \tag{15}$$

where $\sigma n(k)^2$ is the average power of the noise information $\nu n(k)$, which can be calculated using an average (a moving average using a slide window) based on an FIR filter or an average (leaky integration) based on an IIR filter.

The noise information generation unit 7 may calculate the scaling factor $\alpha n+1(k)$ using a perturbation method as $$\alpha n+1(k)=\alpha n(k)+\mu en(k) \tag{16}$$

Alternatively, the noise information generation unit 7 may calculate the scaling factor $\alpha n+1(k)$ using a signum function sgn{en(k)} representing only the sign of the error as $$\alpha n+1(k)=\alpha n(k)+\mu\cdot\mathrm{sgn}\{en(k)\} \tag{17}$$

Similarly, the noise information generation unit 7 may use the LS (Least Squares) algorithm or any other adaptive algorithm. The noise information generation unit 7 can also immediately apply the generated scaling factor. In this case, the implementor of the noise suppressing apparatus 100 may design the modification unit 7 to adapt the scaling factor in real time by modifying equations (15) to (17) with reference to the change from equation (13) to equation (14).

Using the MMSE STSA method, the noise information generation unit 7 recursively adapts the scaling factor. The noise information generation unit 7 adapts the scaling factor $\alpha n(k)$ for each frequency by the same methods as those described using equations (13) to (17).

As the characteristic features of the above-described re-calculation and recursive adaptation algorithms serving as the scaling factor adaptation method, the re-calculation algorithm has a high follow-up speed, and the recursive adaptation algorithm has a high accuracy. To make use these characteristic features, the noise information generation unit 7 may change the adaptation method so as to, for example, first use the re-calculation algorithm and then use the recursive adaptation algorithm. The noise information generation unit 7 may change the adaptation method on condition that the scaling factor has sufficiently approached the optimum value. Alternatively, the modification unit 7 may change the adaptation method when, for example, a predetermined time has elapsed.

Otherwise, the noise information generation unit 7 may change the adaptation method when the modification amount of the scaling factor has fallen below a predetermined threshold.

In the exemplary embodiment, the arrangements and operations other than the generation method of the noise information in the noise information generation unit 7 are the same as in the first exemplary embodiment, and the description thereof will not be repeated.

It may be considered that the noise information is essential information and the scaling information is to be modified in adaptation of the noise information and the scaling information. The noise information generation unit 7 may adapt the noise information for large change and adapt the scaling information for small change. Particularly, in a process of generating the noise information from a default value, fast generation of the noise information is possible by adapting the noise information. When the noise information approaches the right value and an error decreases, accurate output of the noise information generation unit may be obtained by adapting the scaling information.

According to the exemplary embodiment, in addition to the effect of the first exemplary embodiment, it is possible to quickly follow the change of the noise characteristics and to obtain accurate output of the noise information generation unit by optionally combine adaptation of the noise information and adaptation of the scaling information.

Third Exemplary Embodiment

Figure 4:
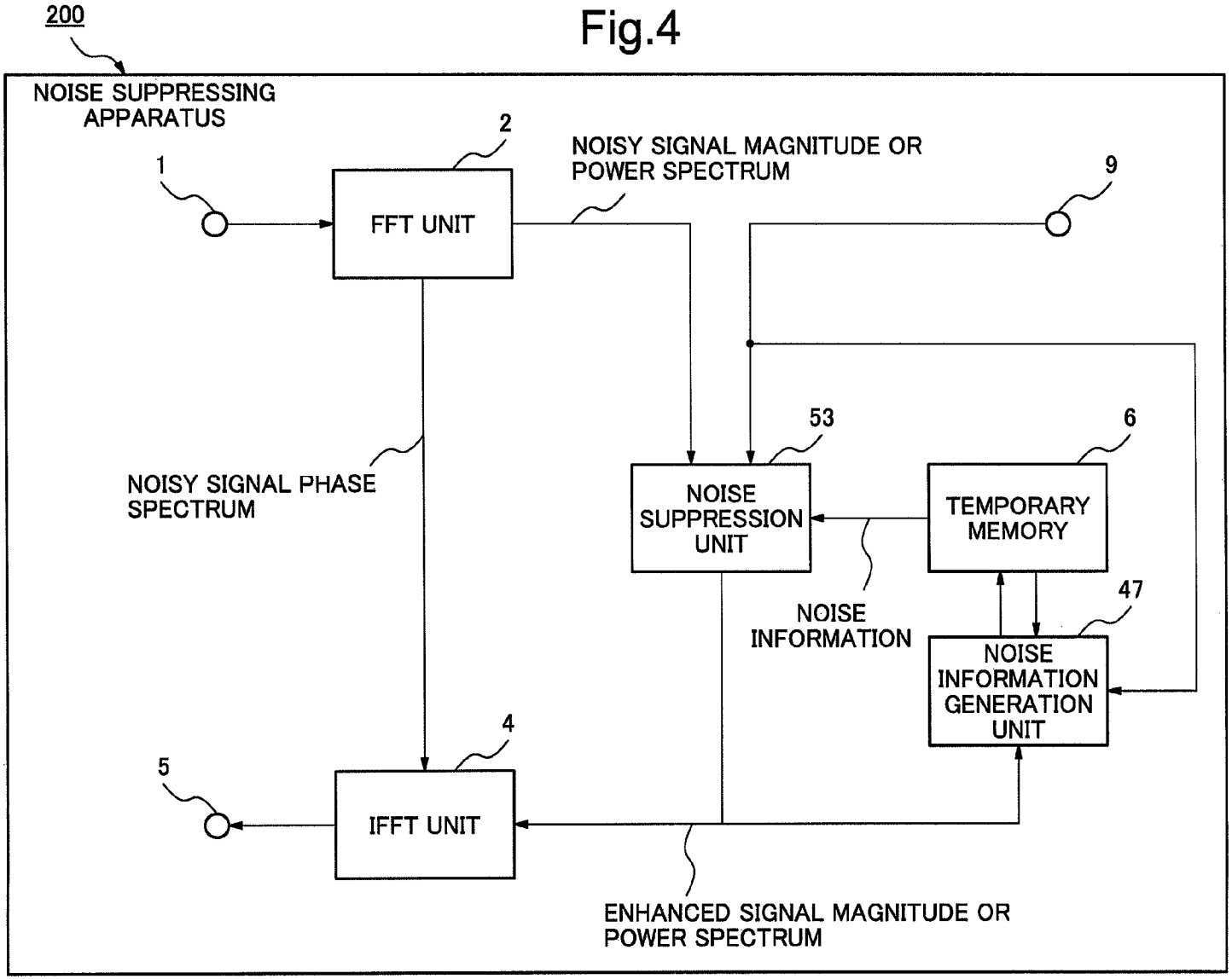
FIG. 4 is a block diagram showing the schematic arrangement of a noise suppressing apparatus 200 according to the third exemplary embodiment of the present invention.

A third exemplary embodiment will be described with reference to FIG. 4. A noise suppressing apparatus 200 includes an input terminal 9 in addition to the arrangement of the first exemplary embodiment. A noise suppression unit 53 and a noise information generation unit 47 receive, from the input terminal 9, information (noise existence information) representing whether a specific noise exists in the inputted degraded signal. Thereby, the noise suppressing apparatus 200 can make it possible to reliably suppress a noise at a timing the specific noise exists and simultaneously generate the noise information. The remaining arrangements and operations are the same as in the first exemplary embodiment, and a detailed description thereof will not be repeated.

The noise suppressing apparatus 200 of the exemplary embodiment does not generate the noise information at a timing a specific noise does not exist. Hence, a higher noise suppression accuracy can be obtained for the specific noise.

Fourth Exemplary Embodiment

Figure 5:
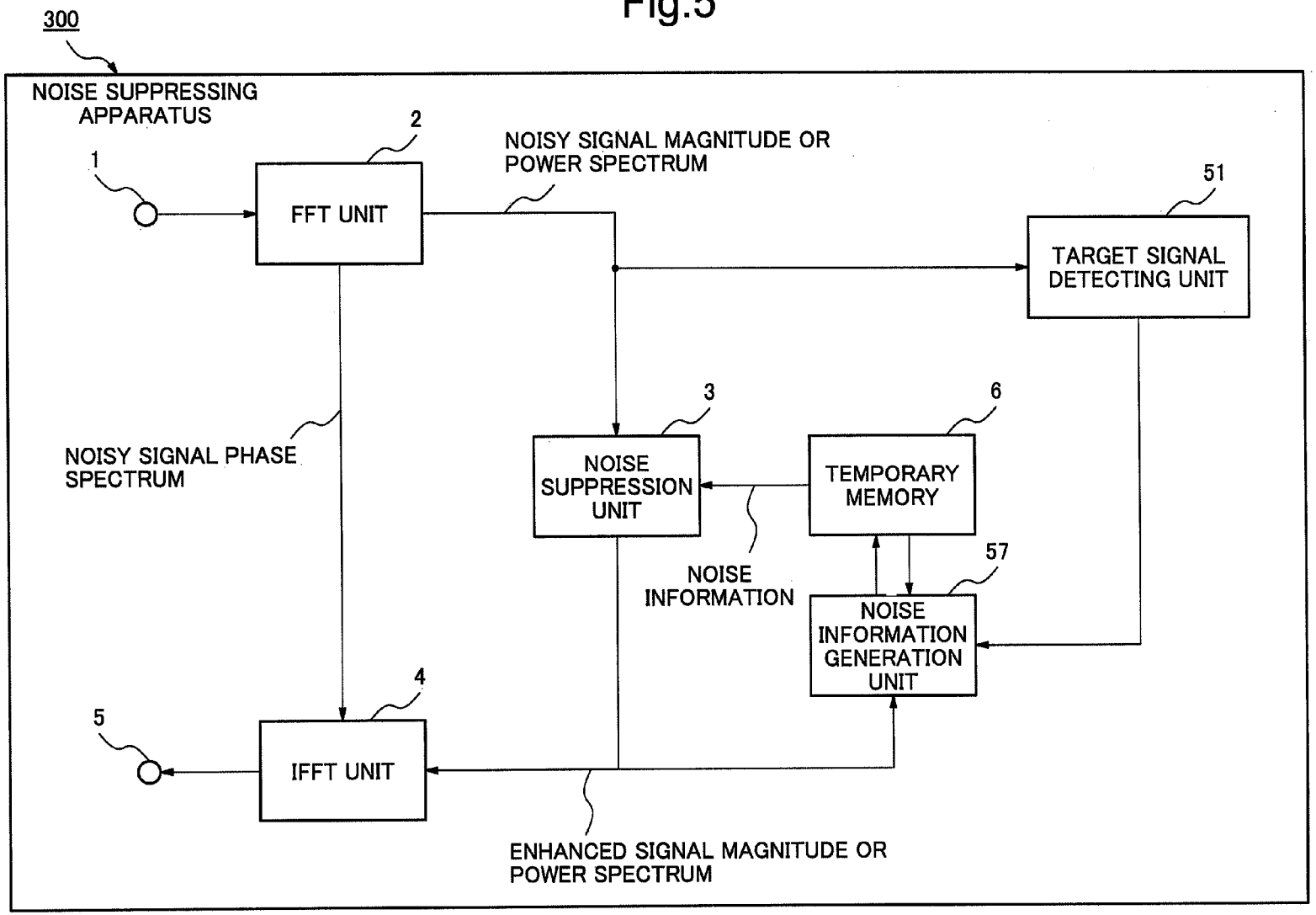
FIG. 5 is a block diagram showing the schematic arrangement of a noise suppressing apparatus 300 according to the fourth exemplary embodiment of the present invention.

A fourth exemplary embodiment will be described with reference to FIG. 5. A noise suppressing apparatus 300 of the exemplary embodiment includes a target signal detecting unit 51. An FFT unit 2 provides the target signal detecting unit 51 with a degraded signal magnitude spectrum. The target signal detecting unit 51 determines whether the target signal exists or the degree of existence in the degraded signal magnitude spectrum.

Based on the determination result from the target signal detecting unit 51, a noise information generation unit 57 generates noise information. For example, without the target signal, the degraded signal includes only noise, and the suppression result of a noise suppression unit 3 has to be zero. Hence, the noise information generation unit 57 adjusts the noise information described in the first exemplary embodiment and the scaling factor described in the second exemplary embodiment so as to obtain zero as the noise suppression result at this time.

On the other hand, when the degraded signal includes the target signal, the noise information generation unit 57 generates the noise information in accordance with the existence ratio of the target signal. For example, if the ratio of the target signal existing in the degraded signal is 10%, the noise information generation unit 57 adapts the noise information stored in a temporary memory 6 partially (only 90%).

The noise suppressing apparatus 300 of the exemplary embodiment generates the noise information in accordance with the ratio of noise in the degraded signal. This allows to obtain a more accurate noise suppression result.

Fifth Exemplary Embodiment

Figure 6:
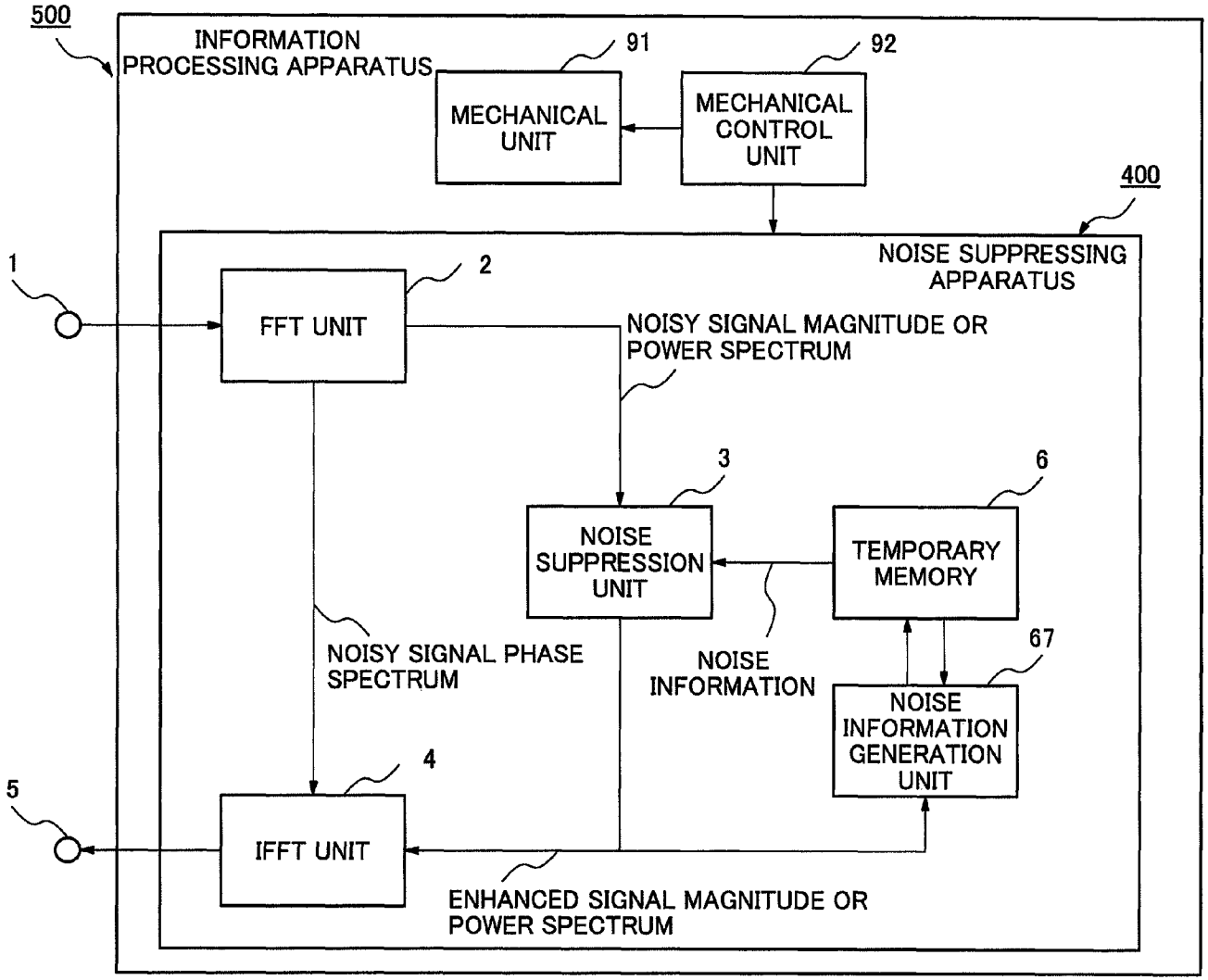
FIG. 6 is a block diagram showing the schematic arrangement of a noise suppressing apparatus 400 according to the fifth exemplary embodiment of the present invention.

A fifth exemplary embodiment will be described with reference to FIG. 6. FIG. 6 is a block diagram showing an information processing apparatus 500 including a noise suppressing apparatus 400 described in the first exemplary embodiment. The information processing apparatus 500 includes a mechanical unit 91 serving as a noise source, and a mechanical control unit 92 that controls the mechanical unit 91. When the mechanical control unit 92 operates the mechanical unit 91 for some reason, the noise suppressing apparatus 400 is provided with the operation information. This allows the noise suppressing apparatus 400 to reliably operate to generate noise information during the operation of the mechanical unit 91.

Alternatively, the mechanical control unit 92 may operate the mechanical unit 91 based on an instruction from the noise suppressing apparatus 400 to generate noise, and simultaneously, a noise information generation unit 67 in the noise suppressing apparatus 400 may generate noise information using a degraded signal including the noise.

Other Exemplary Embodiments

The first to fifth exemplary embodiments have been described above concerning noise suppressing apparatuses having different characteristic features. Exemplary embodiments also incorporate noise suppressing apparatuses formed by combining the characteristic features in whatever way.

The present invention may be applied to a system including a plurality of devices or a single apparatus. The present invention is also applicable when the signal processing program of software for implementing the functions of the exemplary embodiments to the system or apparatus directly or from a remote site. Hence, the present invention also incorporates a program that is installed in a computer to cause the computer to implement the functions of the present invention, a medium that stores the program, and a WWW server from which the program is downloaded.

Figure 7:
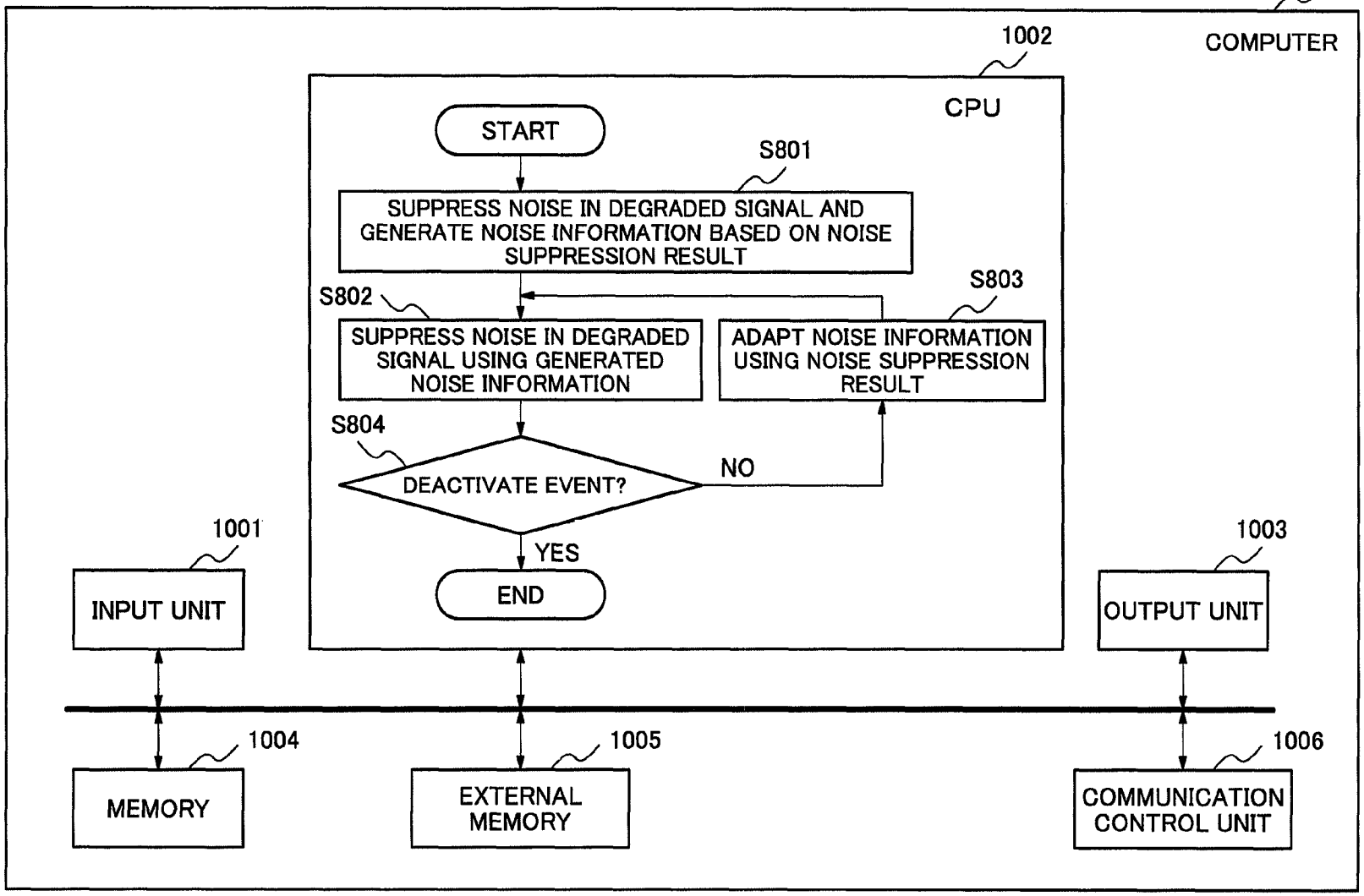
FIG. 7 is a schematic block diagram of a computer 1000 that executes a signal processing program according to still another exemplary embodiment of the present invention.

FIG. 7 is a block diagram of a computer 1000 that executes a signal processing program configured as the first to fifth exemplary embodiments. The computer 1000 includes an input unit 1001, a CPU 1002, an output unit 1003, a memory 1004, an external memory 1005, a communication control unit 1006, and a bus 1007 connecting those.

The CPU 1002 controls the operation of the computer 1000 by reading out the signal processing program. More specifically, upon executing the signal processing program, the CPU 1002 suppresses a noise in the degraded signal and, generates noise information based on the noise suppression result (S801). Next, the CPU 1002 suppresses the noise in the degraded signal using the generated noise information (S802). If a deactivate event has not been generated (S804), the CPU 1002 adapt the noise information using the noise suppression result (S803). That is, the CPU 1002 repeatedly executes noise information generation/adaptation and noise suppression until the deactivate event is inputted. Various deactivate events are assumed, including power-off and microphone-off.

The computer as described above makes it possible to obtain the same effects as in the first to seventh exemplary embodiments.

While the present invention has been described above with reference to exemplary embodiments, the invention is not limited to the exemplary embodiments. The arrangement and details of the present invention can variously be modified without departing from the spirit and scope thereof, as will be understood by those skilled in the art.

This application is based upon and claims the benefit of priority from Japanese patent application No. 2009-255419, filed on Nov. 6, 2009, the disclosure of which is incorporated herein in its entirety by reference.

The invention claimed is:

1. A signal processing method for suppressing a noise in a degraded signal comprising:

updating noise information based on an error of a noise suppression;

storing the noise information in a memory; and suppressing the noise by using the noise information stored in the memory.

2. The signal processing method of claim 1, wherein the noise information is updated by multiplying basic information by a scaling factor.

3. The signal processing method of claim 1, wherein information representing whether a noise exists in the degraded signal is inputted, and the noise information is updated when the noise exists in the degraded signal.

4. The signal processing method of claim 1, wherein a degree of existence of a target signal in the degraded signal is determined by analyzing the degraded signal and, the noise information is updated based on a determination result.

5. An information processing apparatus for suppressing a noise in a degraded signal comprising:

a noise information generation unit that updates noise information based on an error of noise suppression;

a memory that is capable of storing the updated noise information; and a noise suppressor that suppresses the noise suppression by using the updated noise information stored in the memory.

6. The information processing apparatus of claim 5, further comprising:

a mechanical unit serving as a noise source; and a mechanical control unit that controls the mechanical unit, wherein the noise information generation unit updates the noise information at a timing the mechanical control unit generates the noise by operating the mechanical unit.

7. A computer readable medium for storing a signal processing program for suppressing a noise in a degraded signal, the program that causes a computer to execute:

a process of updating noise information based on an error of noise suppression;

a process of storing the noise information in a memory; and a process of suppressing the noise by using the noise information stored in the memory.

8. An information processing apparatus for suppressing a noise in a degraded signal comprising:

noise information generation means for updating noise information based on an error of noise suppression;

memory means for storing the updated noise information; and noise suppress means for suppressing the noise suppression by using the updated noise information stored by the memory means.

* * * * *